US005736659A

United States Patent [19]

Kyle, Jr.

[11] Patent Number: 5,736,659

[45] Date of Patent: Apr. 7, 1998

[54] MUSICAL ROTATING CAKE PLATE

[76] Inventor: Richard Kyle, Jr., 8941 Elberta Ct., Jonesboro, Ga. 30236

[21] Appl. No.: 728,562

[22] Filed: Oct. 10, 1996

[51] Int. Cl.[6] ..... G10F 1/06

[52] U.S. Cl. ..... 84/95.2; 84/94.2; 84/602; 446/265; 446/404

[58] Field of Search ..... 84/95.2, 95.1, 84/94.2, 94.1, 600, 601, 602; 446/265, 404

[56] References Cited

U.S. PATENT DOCUMENTS

| | | | |
|---|---|---|---|
| 243,781 | 7/1881 | Koch | 84/95.2 |
| 5,119,932 | 6/1992 | Semanoff . | |
| 5,130,696 | 7/1992 | Liebmann . | |
| 5,140,885 | 8/1992 | Trivizki | 84/600 |
| 5,271,173 | 12/1993 | Huang . | |

*Primary Examiner*—Cassandra C. Spyrou

[57] ABSTRACT

A rotating musical serving plate (10) with a serving plate (12) removably attached thereto. A support (14) has a base (14A) which is securely attached to a lower distal end of a pedestal (14B). The upper distal end of the pedestal (14B) is securely attached to a bearing ring (14C) having a plurality of bearing retainers (14CA) functioning to rotatably restrain a plurality of bearings (14CB). A drive (16) has plurality of mounting lugs (16AA) securely attached around an outside lower distal portion of a perimeter of a drive housing (16A). The drive (16) is securely attached to the base (14A) by a plurality of mounting lugs (16AA) by a fastener. An upper distal end of the drive housing (16A) is securely attached to a drive cover (16B). The drive cover (16B) at a central portion is securely attached to a drive spindle bearing (16D). The serving plate spindle socket (12AA) cooperates with a drive fluted adapter (16E) to securely removably attach the serving plate spindle socket (12AA) thereto. An audio device (18) has the case (18A) which is securely attached to the base (14A) by a fastener. The case (18A) has an ON/OFF switch (18B) which function to control the audio device (18). The case (18A) further has a speaker (18C) which functions to transmit acoustical energy, the audio device (18) functions to emit speech, music and other sounds appropriate to the product displayed on the serving plate (12).

3 Claims, 3 Drawing Sheets

MUSICAL ROTATING CAKE PLATE

BACKGROUND OF THE INVENTION

1. Field of the Invention

The present invention relates to serving plates. More particularly, the present invention relates to serving plates which rotate and emit audible sounds.

2. Description of the Prior Art

The present invention is a serving plate adapted to rotate and emit audible sounds. There are known serving plates of different sizes, shapes and configurations but, that rotate and emit sounds such as music or speech appropriate for the occasion.

In U.S. Pat. No. 5,271,173, titled Structure of a Musical Picture Frame, invented by Shu-Jen Huang and Min Chuan, a musical picture frame for generating music for a picture frame and creates an elegant and romantic atmosphere for memory. The picture frame can be inserted into a musical structure which is composed of a pressure seat, a rubber conductor, a PC board and a base seat. With fingers pressing on the pressure seat, the rubber conductor will be forced to contact with the PC board circuit and proper music will then be generated.

The patented invention differs from the present invention because the patented invention does not rotate a display apparatus. The patented invention does not support a rotatable display tray.

In U.S. Pat. No. 5,140,885, titled Serving Plate, invented by Jacob Trivizki, a serving plate has a base body in which an integrated battery operated musical box is incorporated. The musical box is connected with two electrical leads which are printed on the plate, such that contact on the plate between the leads is established by a knife when cutting a food product on the plate between the leads.

The patented invention differs from the present invention because the patented invention does not rotate a display apparatus. The patented invention does not support a rotatable display tray. Sounds are emitted when a metal cutting implement makes contact between two electrical contacts when the implement is used for cutting the food product displayed on the invention.

In U.S. Pat. No. 5,130,696, titled Sound-Generating Containment Structure, invented by Theodore Liebman, an arrangement for the generation of or producing of sound s, and more particularly, a containment device incorporating a sound-generating device which will be activated upon opening of the container structure so as emit a programed sequence of sounds. In a more specific aspect, the containment structure may be constituted of a beverage can; for instance, of the type which is widely distributed in the so called soft-drink or carbonated beverage industry, wherein the containment structure incorporates at least one compartment containing a sound generating and emitting device which is activated upon the opening of the containment structure.

The patented invention differs from the present invention because the patented invention is not a food display device but a actual food containment device for soft or other drinks. The present invention is a food product display and holding device which supports food products such as a cake. The patented invention comprises a rotation means to spin the food product at a slow rate for display and simultaneously emit sounds.

In U.S. Pat. No. 5,119,932, titled Musical Base for Desk Top Articles, invented by Ira Semanoff, a musical base includes sections for notepads, writing instrument holders and paper clip dispensers. Each section is provided with a sound producing module for emitting, for instance musical advertising, jingles, and speech. Operation of the module is provided by actuation of a switch or sensor, built into each section the base, when the item is removed or replaced.

The patented invention differs from the present invention because the patented invention does not rotate the displayed items. Further the patented invention is more complex having a separate switch for each item to be removed which emits a separate sound for each item.

Numerous innovations for Musical Rotating Cake Plate have been provided in the prior art that are described as follows. Even though these innovations may be suitable for the specific individual purposes to which they address, they differ from the present invention as hereinafter contrasted.

SUMMARY OF THE INVENTION

Serving plates adapted to accommodate cakes and the like for display and serving are typically static in nature. It is desired to display products form all sides and with an accompanying sounds appropriate for the display. Birthday cakes for example are displayed with musical tunes emitted from sound device while the cake is slowly rotated. emitted from the sound device. Since the sound is recorded onto a micro chip in digital form, any recordable sound can be used.

The types of problems encountered in the prior art are that the display stands did not rotate the product or out put sound.

The present invention solved a long felt need for a display that rotates a product and emits sound such as music and speech which complement the display of the product.

Accordingly, it is an object of the present invention to provide a product display which rotates and emits sounds complementary to the product displayed.

More particularly, it is an object of the present invention to provide music and/or speech outputs.

In keeping with these objects, and with others which will become apparent hereinafter, one feature of the present invention resides, briefly stated, in a rotation means comprised of a motor and engagement means for a cake plate.

When the display is designed in accordance with the present invention, a pleasing and complementary sounds accompany the product. Further the consumer can view all sides of the product without moving.

In accordance with another feature of the present invention, a sound box emits music and/or speech which function to enhance the artistic and informational aspects of the display.

Another feature of the present invention is that it may be battery powered.

Yet another feature of the present invention is that it may be power with standard wall power.

Still another feature of the present invention is that the product tray is removable.

Yet still another feature of the present invention is that the rotation means is securely and removably attached to the bottom of the display tray by a engagement of a fluted shaft end with a complementary socket securely attached to the underside of the product tray.

Still yet another feature of the present invention is that the product tray is supported by a bearing ring having inexpensive bearings distributed around a bearing race. This low friction approach results in a much smaller motor being necessary to rotate the loaded product tray Another feature of the present invention is that music can be played appropriate to the occasion.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawing(s).

BRIEF LIST OF REFERENCE NUMERALS UTILIZED IN THE DRAWING

10—rotating musical serving plate (10)
12—serving plate (12)
12A—top (12A)
12AB—serving plate bearing base (12AB)
12AA—serving plate spindle socket (12AA)
14—support (14)
14A—base (14A)
14B—pedestal (14B)
14C—bearing ring (14C)
14CA—bearing retainer (14CA)
14CB—bearing (14CB)
16—drive means (16)
16A—drive means housing (16A)
16AA—mounting lugs (16AA)
16B—drive means cover (16B)
16C—drive means spindle (16C)
16D—drive means spindle bearing (16D)
16E—drive means fluted adapter (16E)
18—audio device (18)
18A—case (18A)
18B—ON/OFF switch (18B)
18C—speaker (18C)
20—power means (20)
20A—battery holder (20A)
20AA—batteries (20AA)
20AB—power leads (20AB)
20B—ON/OFF switch (20B)
20C—audio device power leads (20C)
22—power Cord (22)
24—cover (24)

BRIEF DESCRIPTION OF THE PREFERRED EMBODIMENT

DETAILED DESCRIPTION OF THE PREFERRED EMBODIMENT

Figure 1:
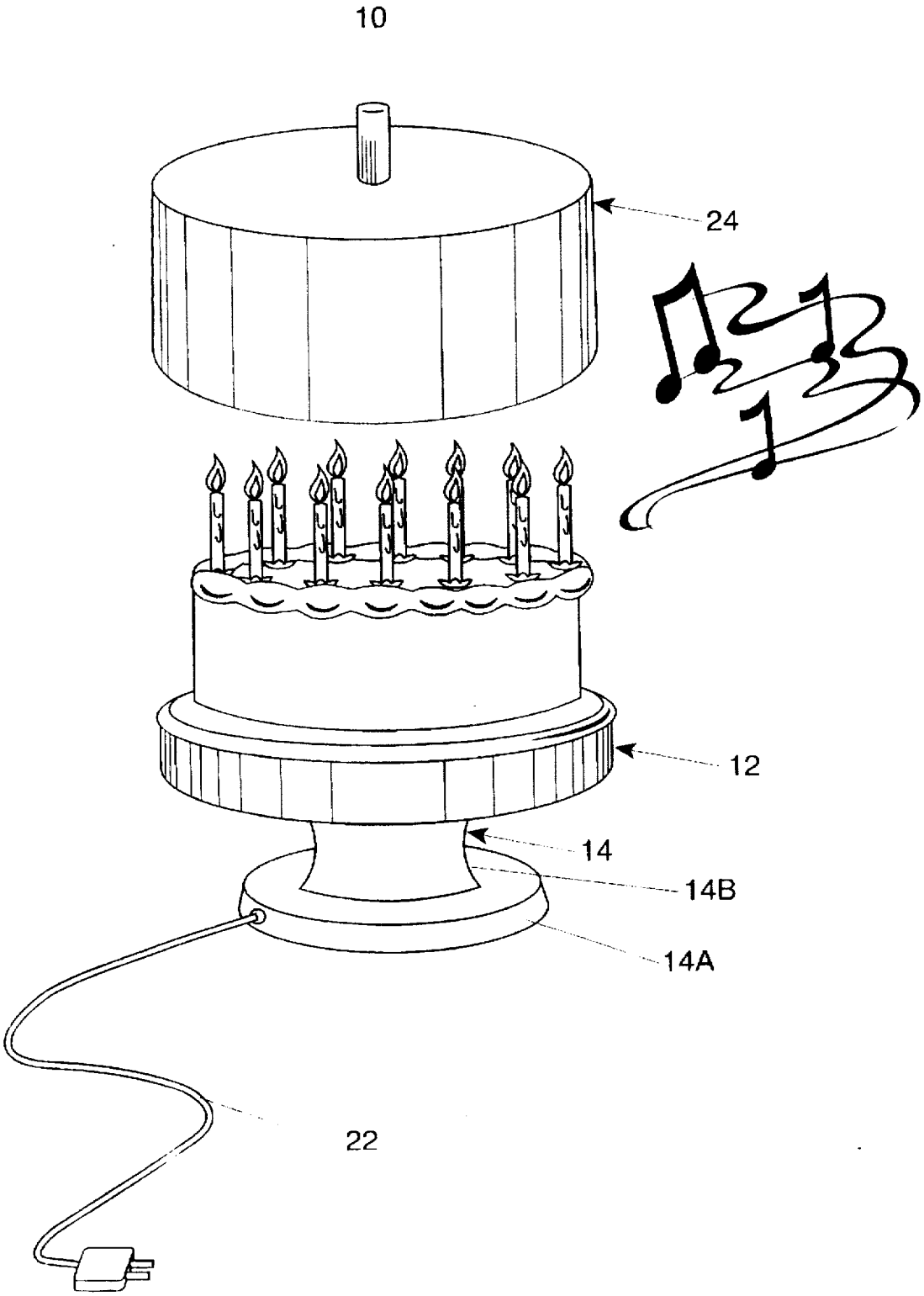
FIG. 1 is a perspective view of rotating musical serving plate.

Firstly, referring to FIG. 1 which is a perspective view of a rotating musical serving plate (10) having the following features: serving plate (12), base (14), base (14A), pedestal (14B), and cover (24).

A rotating musical serving plate (10) comprises a serving plate (12) which is removably attached to a support (14). The support (14) comprises a base (14A) which functions to provide stability to the rotating musical serving plate (10). The base (14A) is centrally securely affixed to a lower distal end of a pedestal (14B). The upper distal end of the pedestal (14B) rotationally supports the serving plate (12).

A cover (24) is removably attached to the serving plate (12) and functions to protect the product. The cover (24) may be manufactured from clear materials so the product may be observed.

Figure 2:
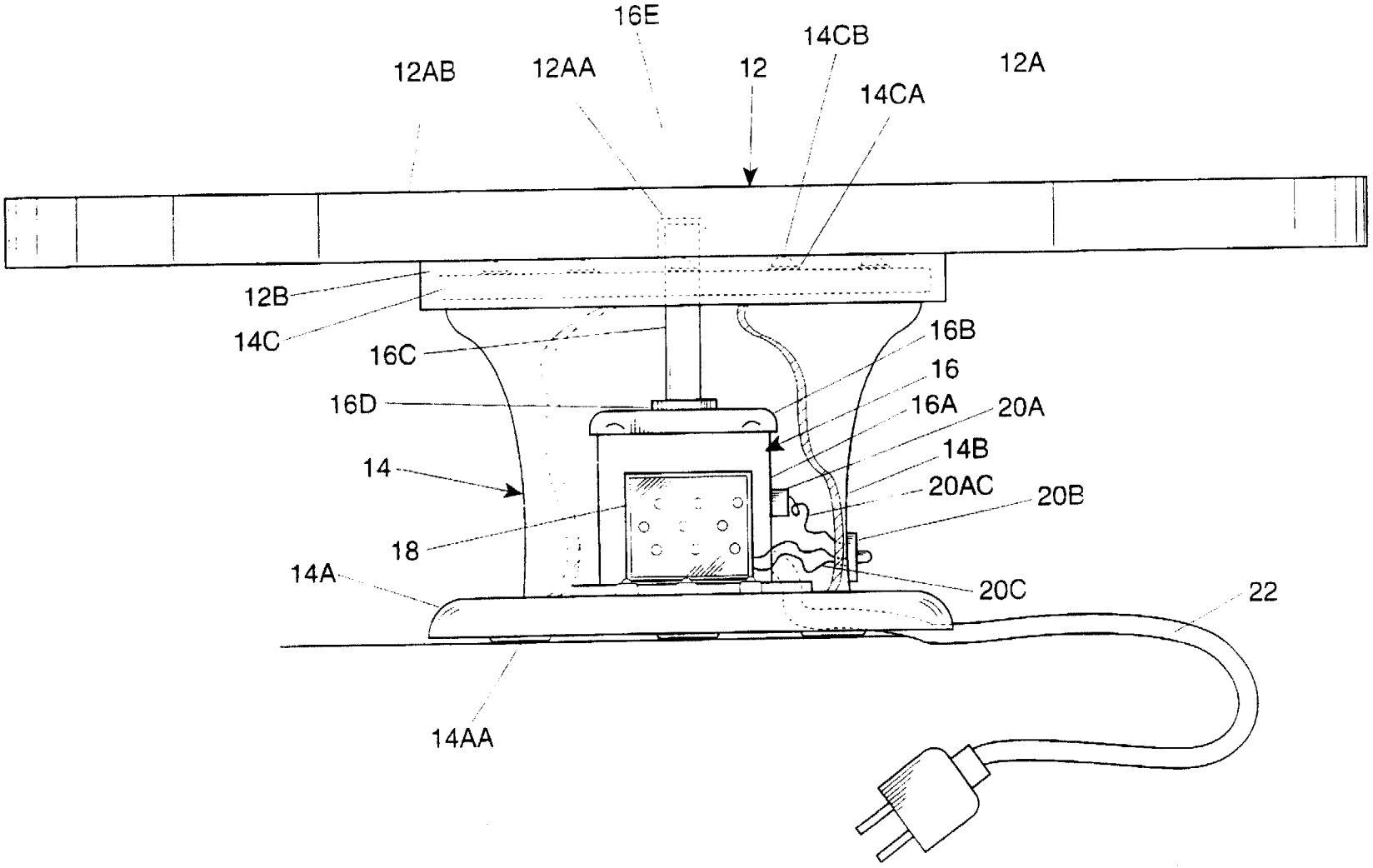
FIG. 2 is a cutaway view of a rotating musical serving plate.

Secondly, referring to FIG. 2 which is a cutaway view of the rotating musical serving plate (10) having the following features: top (12A), serving plate bearing base (12AB), serving plate spindle socket (12AA), support (14), base (14A), pedestal (14B), bearing ring (14C), bearing retainer (14CA), bearing (14CB), drive means (16), drive means housing (16A), mounting lugs (16AA), drive means cover (16B), drive means spindle (16C), drive means spindle bearing (16D), drive means fluted adapter (16E), audio device (18), power means (20), battery holder (20A), batteries (20AA), power leads (20AB), ON/OFF switch (20B), audio device power leads (20C), power cord (22), and cover (24).

The serving plate (12) comprises a top (12A). The top (12A) comprises a serving plate bearing base (12AB) securely attached at a lower side. The serving plate bearing base (12AB) functions as a bearing surface for a beating (14CB). The a serving plate spindle socket (12AA) is securely attached centrally to the underside of the serving plate (12). The serving plate spindle socket (12AA) cooperates with a drive means fluted adapter (16E) to securely removably attached the serving plate spindle socket (12AA) thereto.

A support (14) comprises a base (14A) which is securely attached to a lower distal end of a pedestal (14B). The upper distal end of the pedestal (14B) is securely attached to a beating ring (14C). The bearing ring (14C) comprises a bearing retainer (14CA) which functions to rotatably restrain a plurality of bearings (14CB). The bearing (14CB) are in rollable contact with the serving plate bearing base (12AB).

The base (14A) is securely attached to a drive means (16) at a plurality of mounting lugs (16AA) by a fastening means. The plurality of mounting lugs (16AA) are securely attached around an outside lower distal portion of a perimeter of a drive means housing (16A). An upper distal end of the drive means housing (16A) is securely attached to a drive means cover (16B). The drive means cover (16B) at a central portion is securely attached to a drive means spindle bearing (16D) functioning to rotatably restrain a drive means spindle (16C). The drive means spindle (16C) at one distal end functions to securely and removably engage the serving plate spindle socket (12AA) with a drive means fluted adapter (16E). The drive means spindle (16C) transmits rotational energy from the drive means (16) to the serving plate (12)

An audio device (18) is securely attached to the base (14A) by a fastening means. The audio device (18) functions to emit sounds based on a user's preference.

An ON/OFF switch (20B) controls the sound and rotation of the rotating musical serving plate (10) by a power means (20). The power means (20) comprises a battery holder (20A) which constrains a plurality of batteries (20AA) functioning to provide electricity to the drive means (16) and audio device (18) by a plurality of power leads (20AB) and audio device power leads (20C). The power means (20) may optionally further comprise a power cord (22) adapted to cooperate with household electricity to provide electrical power to the drive means (16). The power cord (22) is electrically connected to the the ON/OFF switch (20B) which is electrically connected to the audio device (18) by the plurality of power leads (20AB) and audio device power leads (20C).

A power cord (22) may replace the battery holder (20A). One distal end of the power cord (22) is electrically connected to standard wall power. The opposite distal end of the power cord (22) is electrically connected to the drive means (16) and audio device (18) by a plurality of power leads (20AB) and audio device power leads (20C).

Figure 3:
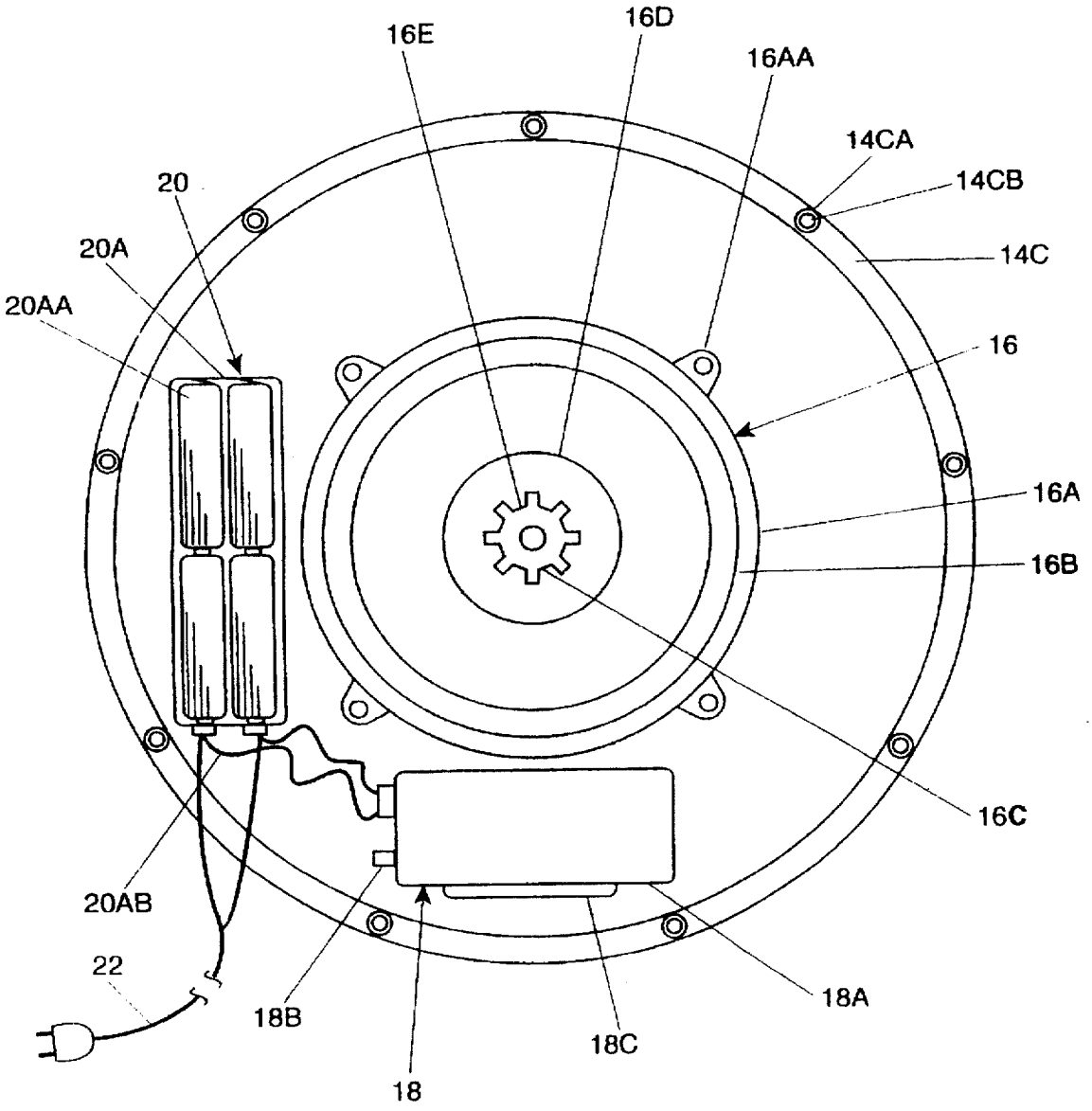
FIG. 3 is a top view of a rotating musical serving plate.

Lastly, referring to FIG. 3 which is a top view of a rotating musical serving plate (10) having the following features: bearing ring (14C), bearing retainer (14CA), bearing (14CB), drive means (16), drive means housing (16A), mounting lugs (16AA), drive means cover (16B), drive means spindle (16C), drive means spindle bearing (16D), drive means fluted adapter (16E), audio device (18), case (18A), ON/OFF switch (18B), speaker (18C), power means (20), battery holder (20A), batteries (20AA), power leads (20AB), and audio device power leads (20C).

The bearing ring (14C) comprises the bearing retainer (14CA) which functions to restrain the bearing (14CB). The bearing (14CB) functions to provide a low friction contact with the serving plate bearing base (12AB).

The plurality of mounting lugs (16AA) are securely attached around an outside lower distal portion of a perimeter of a drive means housing (16A). The plurality of mounting lugs (16AA) functions to securely attached the drive means (16) to the base (14A). An upper distal end of the drive means housing (16A) is securely attached to a drive means cover (16B). The drive means cover (16B) at a central portion is securely attached to a drive means spindle bearing (16D) functioning to rotatably restrain a drive means spindle (16C). The drive means spindle (16C) at one distal end functions to securely and removably engage the serving plate spindle socket (12AA) with a drive means fluted adapter (16E). The drive means spindle (16C) transmits rotational energy from the drive means (16) to the serving plate (12).

The audio device (18) comprises the case (18A) which is securely attached to the base (14A) by a fastening means. The case (18A) comprises an ON/OFF switch (18B) which function to control the audio device (18). The case (18A) further comprises a speaker (18C) which functions to transmit acoustical energy. The audio device (18) is electrically connected to the power means (20) by the audio device power leads (20C). The power means (20) comprises the battery holder (20A) which contain the batteries (20AA) which electrically connected to the power leads (20AB) and the audio device power leads (20C).

It will be understood that each of the elements described above, or two or more together, may also find a useful application in other types of constructions differing from the type described above.

While the invention has been illustrated and described as embodied in a Musical Rotating Cake Plate, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A rotating musical serving plate (10) comprising:

A) a serving plate (12) comprises a top (12A), the top (12A) comprises a serving plate bearing base (12AB) which is securely attached at a serving plate (12) lower side, a serving plate spindle socket (12AA) is securely attached centrally to the underside of the serving plate (12);

B) a support (14) comprises a base (14A) which is securely attached to a lower distal end of a pedestal (14B), the upper distal end of the pedestal (14B) is securely attached to a bearing ring (14C), the bearing ring (14C) comprises a plurality of bearing retainers (14CA) functioning to rotatably restrain a plurality of bearings (14CB), the plurality of bearings (14CB) are in rollable contact with the serving plate bearing base (12AB), the serving plate bearing base (12AB) functions as a surface for the plurality of bearings (14CB);

C) a drive means (16) comprises plurality of mounting lugs (16AA) securely attached around an outside lower distal portion of a perimeter of a drive means housing (16A), the drive means (16) is securely attached to the base (14A) at plurality of mounting lugs (16AA) by a fastening means, an upper distal end of the drive means housing (16A) is securely attached to a drive means cover (16B), the drive means cover (16B) at a central portion is securely attached to a drive means spindle bearing (16D) functioning to rotatably restrain a drive means spindle (16C), the drive means spindle (16C) at one distal end functions to securely and removably engage the serving plate spindle socket (12AA) with a drive means fluted adapter (16E), the drive means spindle (16C) is connected at the opposite distal end to the drive means (16), the drive means spindle (16C) transmits rotational energy from the drive means (16) to the serving plate (12), the serving plate spindle socket (12AA) cooperates with the drive means fluted adapter (16E) to securely removably attach the serving plate spindle socket (12AA) thereto, the drive means (16) functions to rotate the serving plate (12);

D) an audio device (18) comprises a case (18A) which is securely attached to the base (14A) by a second fastening means, the case (18A) comprises an ON/OFF switch (18B) which function to control the audio device (18), the case (18A) further comprises a speaker (18C) which functions to transmit acoustical energy, the audio device (18) functions to emit speech, music and sounds appropriate to the product displayed on the serving plate (12); and E) a power means (20) comprises a battery holder (20A) which constrains a plurality of batteries (20AA), the power means (20) functions to provide electricity to the drive means (16) and audio device (18) by a plurality of power leads (20AB) and audio device power leads (20C), when a user activates the ON/OFF switch (20B) electricity is sent to the audio device (18) and the drive means (16) which activates sound and rotation.

2. The rotating musical serving plate (10) as described in claim 1, wherein the serving plate (12) at a upper edge is removably attached to a cover (24) which functions to protect a produce.

3. The rotating musical serving plate (10) as described in claim 1, wherein the power means (20) is a power cord (22) adapted to cooperate with household electricity to provide electrical power to the drive means (16) and audio device (18) by the plurality of power leads (20AB) and audio device power leads (20C), through the ON/OFF switch (20B).

* * * * *